US007188611B2

(12) United States Patent
Schmieder

(10) Patent No.: US 7,188,611 B2
(45) Date of Patent: Mar. 13, 2007

(54) FUEL INJECTION SYSTEM

(75) Inventor: Dietmar Schmieder, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/188,171

(22) Filed: Jul. 22, 2005

(65) Prior Publication Data

US 2006/0021601 A1 Feb. 2, 2006

(30) Foreign Application Priority Data

Jul. 29, 2004 (DE) ..... 10 2004 036 626

(51) Int. Cl.
*F02M 55/02* (2006.01)
*F02M 55/04* (2006.01)

(52) U.S. Cl. ..... 123/469; 123/470

(58) Field of Classification Search ..... 123/470, 123/468, 469, 456, 447, 467; 285/382.7
See application file for complete search history.

(56) References Cited

U.S. PATENT DOCUMENTS 4,295,452 A * 10/1981 Lembke et al. ..... 123/470
6,321,719 B1 * 11/2001 Schwegler ..... 123/467
6,843,233 B2 * 1/2005 Berger et al. ..... 123/468
6,871,634 B2 * 3/2005 Berger et al. ..... 123/456
6,877,484 B2 * 4/2005 Reiter ..... 123/468
6,923,162 B2 * 8/2005 Reiter ..... 123/490
2004/0050365 A1 * 3/2004 Reiter ..... 123/468
2004/0112338 A1 * 6/2004 Berger et al. ..... 123/468

FOREIGN PATENT DOCUMENTS

DE 101 08 467 9/2002

* cited by examiner

*Primary Examiner*—Mahmoud Gimie
(74) *Attorney, Agent, or Firm*—Kenyon & Kenyon LLP

(57) ABSTRACT

A fuel injection system, in particular for direct injection of fuel into the combustion chamber of an internal combustion engine has a plurality of fuel injectors, whose injection ends, at least, are situated in receptacle bore holes of a cylinder head. The inlet side of the fuel injectors has a connecting piece, which engages with a supply line segment. Pressurized fuel is supplied to the fuel injector via the supply line segment. The connecting piece is sealed off from the supply line segment by a gasket. The gasket has a sleeve-shaped design and has a plastically deformable shaped area, which is plastically deformed during the assembly of the supply line segment with the connecting piece, and has elastic properties while in operation.

13 Claims, 3 Drawing Sheets

FUEL INJECTION SYSTEM

BACKGROUND INFORMATION

German Patent Application No. DE 101 08 467, for example, describes a fuel injector which is supplied with fuel via a fuel distribution line. The injection end of the fuel injector is inserted into a receptacle opening of a cylinder head. The inlet end of the fuel injector projects into a receptacle opening of the fuel distribution line and is radially surrounded by an annular gasket, which seals off the fuel injector from the fuel distribution line. The gasket is designed as an O-ring and is made of a rubber-type material.

The disadvantage of the fuel injection system known from the above-mentioned publication is in particular that the gasket is inadequate for higher fuel pressures. Furthermore, the radial gasket is incapable of compensating for axial tolerances which appear, for example, in operation due to different degrees of thermal expansion of the fuel distribution line and the cylinder head because of the inclination of the fuel injectors with respect to the receptacle openings. Furthermore, the gaskets can be manufactured only for a very narrow temperature range. The fuel can diffuse through annular gaskets made of a rubber-type material.

SUMMARY OF THE INVENTION

The fuel injection system according to the present invention has the advantage over the related art that the assembly of the fuel injection system may take place in a considerably simpler manner because, due to the elastic axial expansibility of the gasket, the supply line segment may be attached to the cylinder head without elastic spring elements for compensating for axial variations. Variations in the inclination of the fuel injectors with respect to the supply line segment, which occur, for example, due to different degrees of thermal expansion of the supply line segment and the cylinder head, may be compensated without leakage by the gasket.

The shaped area advantageously extends over a partial axial length of the gasket as an undulated bellows-shaped area or an undulated area. The elastic spring constant may thus be improved and the hydraulic fuel pressures acting on the gasket may be used for improving the seal.

It is also advantageous to manufacture the gasket by deep drawing or stamping. The gasket, in particular the undulated area, may thus be manufactured in a particularly simple manner.

The seal may be considerably improved with respect to the variations in inclination between the supply line segment and the cylinder head, i.e., the fuel injector, due to a conically widening inner contour of the gasket ends and rounded segments engaging therewith.

The material of the gasket, in particular in its contact area having the inlet segment and/or the outlet segment, is advantageously either considerably harder or considerably softer than the corresponding contact area of the inlet segment or the outlet segment. The seal may thus be further improved and manufacturing tolerances may be increased.

The service life of the gasket may be improved by coating.

The material of the gasket, in particular in the contact area having the inlet segment and/or the outlet segment, is preferably designed to be either considerably harder or considerably softer than the corresponding contact area of the inlet segment or the outlet segment.

The inlet segment and/or the outlet segment is/are preferably made of steel. The gasket, at least in the contact area having the inlet segment or the outlet segment, is preferably made of bronze.

The inlet segment and/or the outlet segment is/are preferably made of aluminum. The gasket, at least in the contact area having the inlet segment or the outlet segment, is preferably made of steel, C45 steel in particular.

The gasket is coated at least in the inlet and/or outlet areas, in particular using an anti-wear carbon coating.

DETAILED DESCRIPTION

Figure 1:
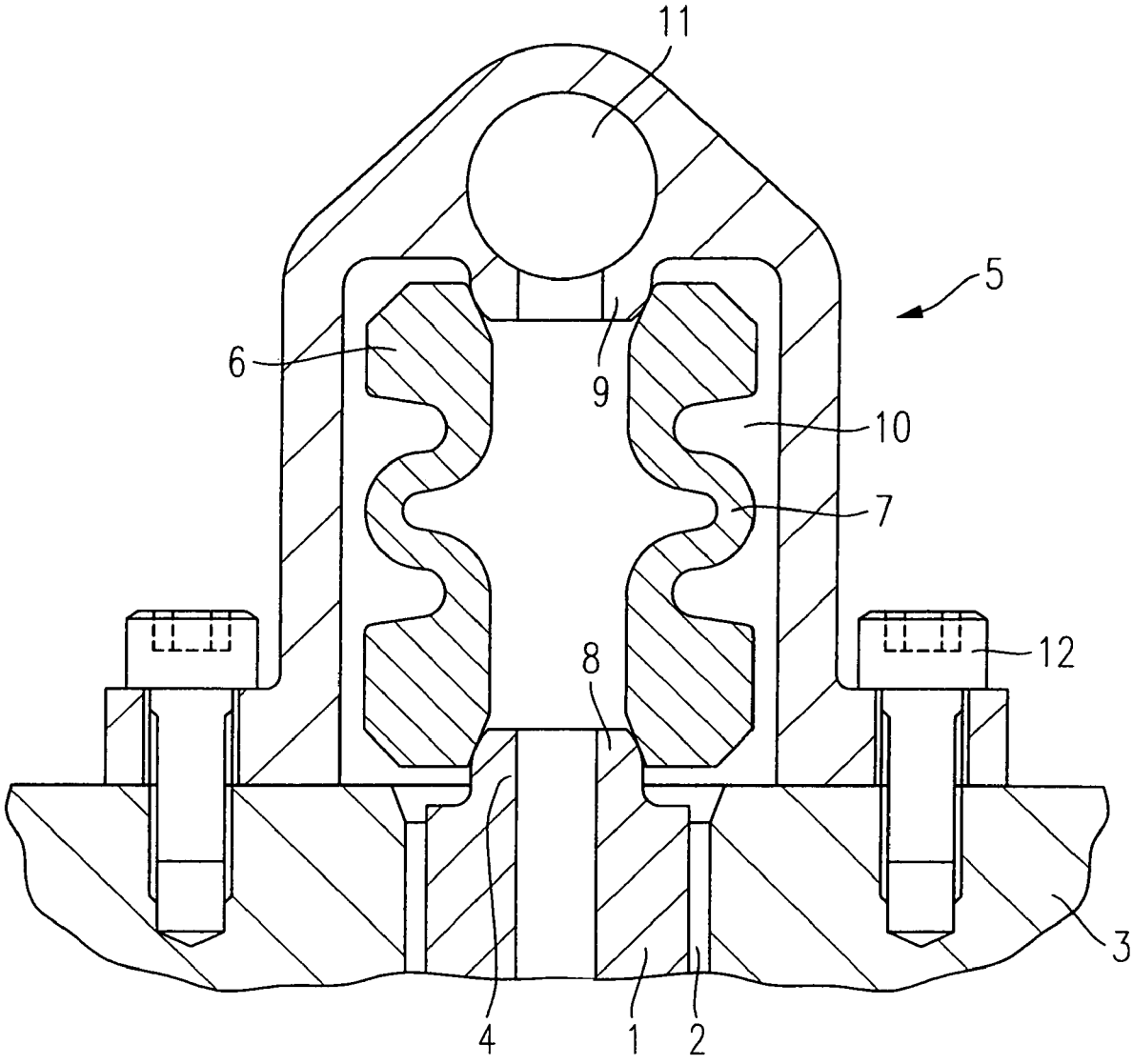
FIG. 1 shows a schematic illustration of a first exemplary embodiment of a fuel injection system according to the present invention.

An exemplary embodiment of the fuel injection system according to the present invention, illustrated in FIG. 1, is designed here as a fuel injection system for supplying fuel and holding down fuel injectors for direct-injection internal combustion engines which may be self-igniting or externally ignited.

The fuel injection system according to the present invention schematically illustrated as an example essentially has a supply line segment 5, a fuel injector 1, and a gasket 6 elastically and pressure-tightly connecting supply line segment 5 to fuel injector 1. In this exemplary embodiment, almost the entire length of fuel injector 1 is situated in a receptacle bore hole 2 of cylinder head 3. On the inlet side, fuel injector 1 has a connecting piece 4, through which fuel is supplied under pressure to fuel injector 1. Connecting piece 4 projects slightly out from receptacle bore hole 2.

Supply line segment 5 is part of a fuel rail and, for each fuel injector 1, it has a receptacle chamber 10, into which connecting piece 4 projects. Supply line segment 5 has a U-shaped design in the area of receptacle chamber 10, supply line segment 5 being situated in such a way that the open U-shaped area covers receptacle bore hole 2. A supply bore hole 11 runs in the upper area of supply line segment 5 facing away from the open U-shaped area. In this exemplary embodiment, supply bore hole 11 opens into gasket 6, situated in receptacle chamber 10, via a peg-shaped outlet segment 9. Outlet segment 9 has a round cross-section, for example. The outer contour of outlet segment 9 is uniformly rounded over its circumference. In this exemplary embodiment, outlet segment 9 sealingly engages with the inner contour of the inlet-side area of sleeve-shaped gasket 6, which in this exemplary embodiment conically tapers off in the flow direction. Due to the rounding, i.e., the conical tapering of the inner contour, a spherical/conical gasket is formed, which remains tight even in the event of variations in the inclination of gasket 6 with respect to outlet area 9. In particular, slightly different degrees of thermal expansion of supply line segment 5 and cylinder head 3, which occur in operation due to temperature and material differences, may thus be compensated.

In this exemplary embodiment, gasket 6 has an undulated or undulated bellows-shaped area 7. The length of gasket 6 is selected such that it is plastically deformed in shaped area 7 during assembly without losing its elastic properties in this area. The dimensions of shaped area 7 are such that it is capable of elastically exerting the required pressure on fuel injector 1, even in operation. Gasket 6 is made of bronze or steel, for example.

The inner contour of the outlet-side area of gasket 6 widens conically in the flow direction and also forms a spherical/conical gasket together with the equally round cross-section shape of an inlet segment 8 of connecting piece 4, which has a rounded outer contour.

Supply line segment 4 is immovably joined with cylinder head 3 by screw fasteners 12.

Due to its elastic properties, gasket 6 elastically presses fuel injector 1 into receptacle bore hole 2.

Figure 2:
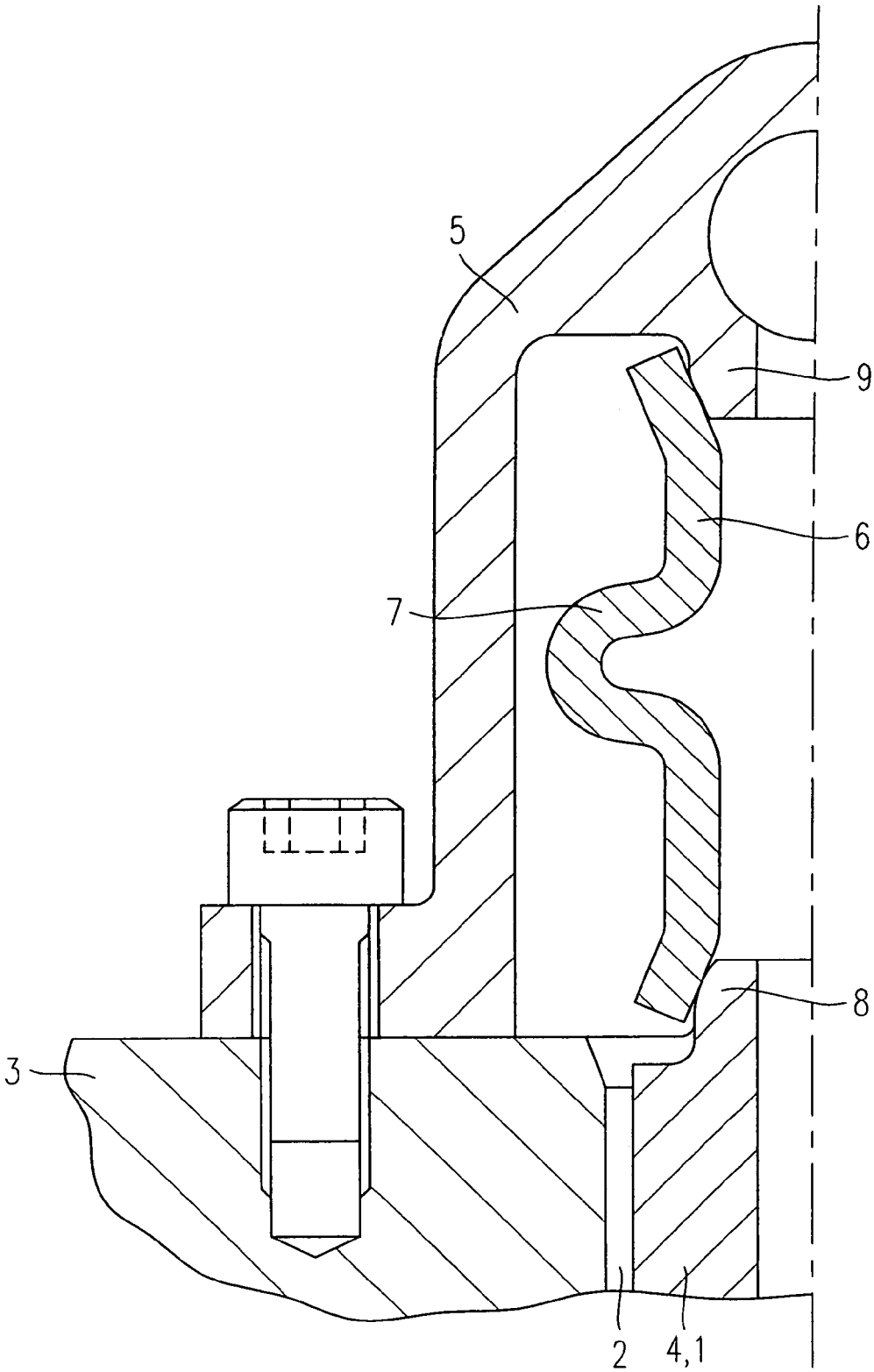
FIG. 2 shows a schematic illustration of a second exemplary embodiment according to the present invention of the fuel injection system.

FIG. 2 shows a schematic illustration of another fuel injection system according to the present invention. The wall of sleeve-shaped gasket 6 has a uniformly great thickness over its entire axial length and is manufactured by stamping.

Figure 3:
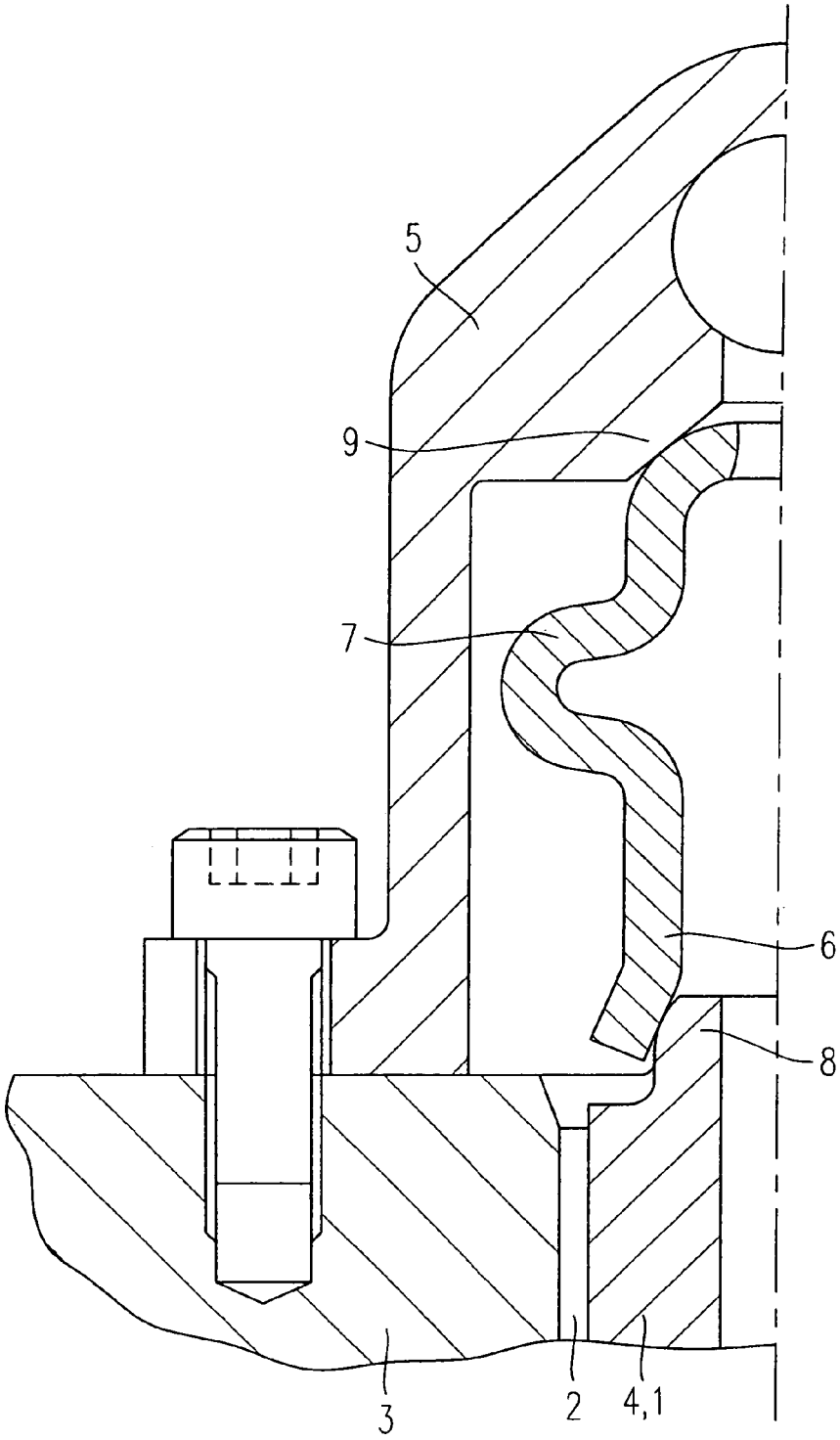
FIG. 3 shows a schematic illustration of a third exemplary embodiment according to the present invention of the fuel injection system.

FIG. 3 shows a schematic illustration of another fuel injection system according to the present invention. In contrast with the exemplary embodiment of FIG. 2, the outer contour of the gasket is rounded and conically tapers off in the direction opposite to the flow direction in the inlet area; in this exemplary embodiment it engages with the inner contour of outlet segment 9, which conically tapers off in the direction opposite to the flow direction, forming a spherical/conical gasket. The gasket is manufactured by deep drawing, and the inlet area of the gasket has a centrally located bore hole, through which fuel may flow from outlet segment 9 into the inside of gasket 6.

The present invention is not limited to the exemplary embodiments illustrated. The described features of the exemplary embodiments may be combined in any desired manner.

What is claimed is:

1. A fuel injection system comprising:

a connecting piece;

a supply line segment;

a plurality of fuel injectors, whose injection ends, at least, are situated in receptacle bore holes of a cylinder head and whose inlet sides engage with the connecting piece in the supply line segment, pressurized fuel being supplied to the fuel injector via the supply line segment; and a gasket sealing off the connecting piece from the supply line segment, the gasket having a sleeve-shaped design and a plastically deformable shaped area which is plastically deformed during an assembly of the supply line segment with the connecting piece and has elastic properties in operation, wherein an inner contour of at least one of an inlet-side end and an outlet-side end of the gasket widens conically outward and at least one of an outlet segment of the supply line segment and an inlet segment of the connecting piece sealingly engages with the conical inner contour of the at least one of the inlet-side end and the outlet-side end of the gasket and is rounded in an area of its surfaces in contact with conical surfaces of the inner contour of the at least one of the inlet-side end and the outlet-side end of the gasket.

2. The fuel injection system according to claim 1, wherein the shaped area has at least one of an undulated bellows-shaped and an undulated area extending over a partial axial length.

3. The fuel injection system according to claim 1, wherein the gasket is formed by one of deep drawing and stamping.

4. The fuel injection system according to claim 1, wherein a spherical/conical gasket is formed.

5. The fuel injection system according to claim 1, wherein an outer contour of at least one of an inlet-side end and an outlet-side end of the gasket tapers off outward, in one of a rounded and a circular shape.

6. The fuel injection system according to claim 5, wherein an inner contour of an outlet segment of the supply line segment widens conically in a flow direction, and the inlet-side end of the gasket sealingly engages with a widening area, forming a spherical/conical gasket.

7. The fuel injection system according to claim 5, wherein an inner contour of an inlet segment of the connecting piece tapers off conically in a flow direction, and the outlet-side end of the gasket sealingly engages with a widening area, forming a spherical/conical gasket.

8. The fuel injection system according to claim 1, wherein a material of the gasket, in a contact area having at least one of an inlet segment and an outlet segment is one of substantially harder and substantially softer than a corresponding contact area of one of the inlet segment and the outlet segment.

9. The fuel injection system according to claim 8, wherein the at least one of the inlet segment and the outlet segment is made of steel, and the gasket, at least in the contact area having the at least one of the inlet segment and the outlet segment, is made of bronze.

10. The fuel injection system according to claim 8, wherein the at least one of the inlet segment and the outlet segment is made of aluminum, and the gasket, at least in the contact area having the at least one of the inlet segment and the outlet segment, is made of C45 steel.

11. The fuel injection system according to claim 1, wherein the gasket is coated at least in at least one of inlet and outlet areas, with an anti-wear carbon coating.

12. The fuel injection system according to claim 1, wherein the fuel injection system is for a direct injection of fuel into a combustion chamber of an internal combustion engine.

13. A fuel injection system comprising:

a connecting piece;

a supply line segment;

a plurality of fuel injectors, whose injection ends, at least, are situated in receptacle bore holes of a cylinder head and whose inlet sides engage with the connecting piece in the supply line segment, pressurized fuel being supplied to the fuel injector via the supply line segment; and a gasket sealing off the connecting piece from the supply from line segment, the gasket having a sleeve-shaped design and a plastically deformable shaped area which is plastically deformed during an assembly of the supply line segment with the connecting piece and has elastic properties in operation, wherein the outer contour of the gasket is rounded and conically tapers off in the direction opposite to the flow direction, forming a spherical/conical gasket.

* * * * *